US006059394A

United States Patent [19]

Moriyama

[11] Patent Number: 6,059,394

[45] Date of Patent: May 9, 2000

[54] DRIVING METHOD FOR INK JET RECORDING HEAD

[75] Inventor: Jiro Moriyama, Yokohama, Japan

[73] Assignee: Canon Kabushiki Kaisha, Tokyo, Japan

[21] Appl. No.: 08/917,193

[22] Filed: Aug. 25, 1997

Related U.S. Application Data

[60] Continuation of application No. 08/011,548, Feb. 1, 1993, which is a division of application No. 07/637,956, Jan. 9, 1991, Pat. No. 5,221,931, which is a continuation of application No. 07/342,814, Apr. 25, 1989, abandoned.

[30] Foreign Application Priority Data

Apr. 26, 1988 [JP] Japan ..... 63-103595

[51] Int. Cl.[7] ..... B41J 2/045

[52] U.S. Cl. ..... 347/11; 347/14

[58] Field of Search ..... 347/11, 10, 9, 347/14

[56] References Cited

U.S. PATENT DOCUMENTS

| | | | |
|---|---|---|---|
| 4,521,786 | 6/1985 | Bain | 346/140 R |
| 4,561,025 | 12/1985 | Tsuzuki | 358/298 |
| 4,563,689 | 1/1986 | Murakami et al. | 346/1.1 |
| 4,714,935 | 12/1987 | Yamamoto et al. | 346/140 R |
| 4,897,665 | 1/1990 | Aoki | 347/10 |
| 5,204,695 | 4/1993 | Tokunaga | 347/11 |
| 5,221,931 | 6/1993 | Moriyama | 347/10 |
| 5,264,865 | 11/1993 | Shimoda | 347/11 |

FOREIGN PATENT DOCUMENTS

| | | | |
|---|---|---|---|
| 171967 | 10/1983 | Japan | B41J 3/04 |
| 59-176055 | 10/1984 | Japan . | |
| 62-025060 | 2/1987 | Japan . | |
| 63-094850 | 4/1988 | Japan . | |
| 63-094851 | 4/1988 | Japan . | |

*Primary Examiner*—Joseph Hartary
*Attorney, Agent, or Firm*—Fitzpatrick, Cella, Harper & Scinto

[57] ABSTRACT

A driving method for an ink jet recording head having an electrical converting element provided to vary the volume of an ink path through which ink flows to perform gradient recording in accordance with recording information, the electrical converting element being driven by applying electrical signals including a first driving pulse for enlarging the volume of the ink path, the first driving pulse having a duration t1, and a second driving pulse having a duration t2. This method involves selecting the duration t2 of the second driving pulse and the voltage of the second driving pulse corresponding to the recording information, inputting an input pulse representing a reference timing for beginning driving of the electric conversion element, delaying the start of the first driving pulse after the input pulse until a first time period corresponding to the duration t2 passes, delaying the start of the first driving pulse after the input pulse until a first time period corresponding to the duration t2 passes, and delaying the start of the second driving pulse after the input pulse until a second predetermined time period corresponding to a sum of t1 and t2 passes.

17 Claims, 6 Drawing Sheets

FIG. 2 - PRIOR ART

FIG. 7(a)
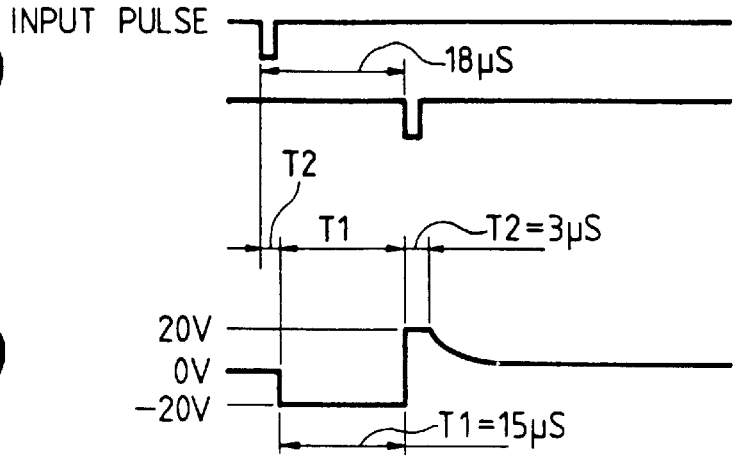
FIG. 7(b)
FIG. 7(c)
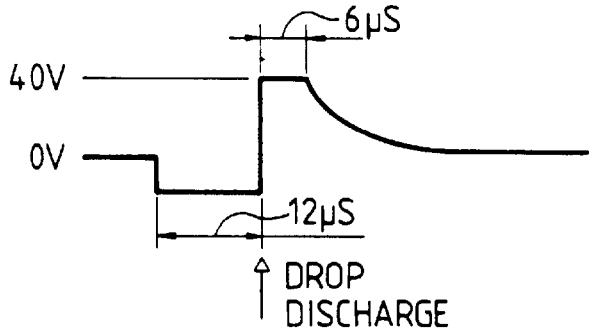
FIG. 7(d)
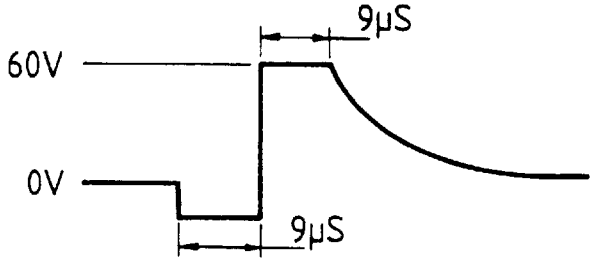
FIG. 7(e)
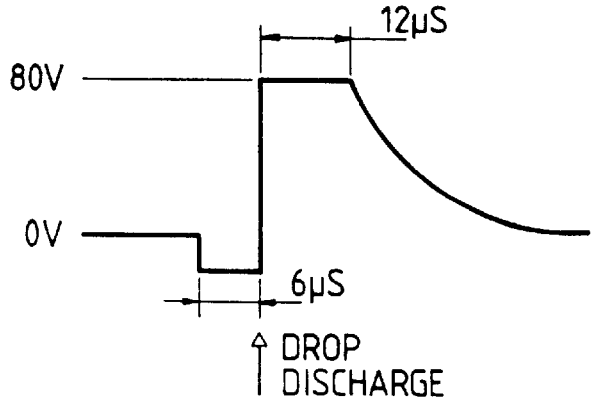

DRIVING METHOD FOR INK JET RECORDING HEAD

This application is a continuation of application Ser. No. 08/011,548 filed Feb. 1, 1993, now abandoned, which was a division application Ser. No. 07/637,956, filed Jan. 9, 1991, now U.S. Pat. No. 5,221,931, which was a continuation of application Ser. No. 07/342,814, filed Apr. 25, 1989, now abandoned.

BACKGROUND OF THE INVENTION

1. Field of the Invention

This invention relates to a method for driving, for example, an on-demand type ink jet recording head which is used in an ink jet recording device and discharges ink droplets by applying a driving voltage to an electromechanical transducing element of the head.

2. Related Background Art

FIG. 1 is a schematic upper view of an example of an ink jet recording device in general, FIG. 2 of a block diagram showing its control system.

In FIG. 1, numeral 1 is a platen which rotates in predetermined increments to enable sub-scanning during the recording of a recording medium (not shown) wound therearound. Numeral 2 is a line feed motor which rotates to the rotational shaft of the platen 1 through a gear 3. Numeral 4 is an ink jet recording head (hereinafter called "head") freely slidable on a guide bar (not shown) arranged parallel to the platen 1, the head is provided with a plurality of discharge openings or nozzles 5 for discharging ink as droplets. Numeral 6 is a belt for moving the head 5 reciprocally in the longitudinal direction of the platen 1, numerals 7 and 8 are pulleys arranged at the both ends of the belt 6, and numeral 9 a carriage motor for rotating the pulley 8.

Numeral 10 is a paper sensor for detecting the presence of recording medium arranged in the vicinity of the surface of the platen 1, numeral 11 an encoder sensor mounted on the head 4, and numeral 12 a linear encoder arranged parallel to the platen 1 and also opposed to the encoder sensor 11. Numeral 13 is a home position sensor for detecting that the head 4 is in the home position, numeral 14 is a cap which is used when restoring poor discharge including non-discharge. Numeral 15 is a motor which is the driving source for with respect to the head 4, and numeral 16 a cap sensor for detecting that the cap 14 is mounted on the head 4.

In the above constitution, when the recording medium is mounted on the platen 1, it the paper sensor 10 to be made in a recordable state. When the recording start button is pushed, the carriage is moved, and the head 4 moves from the home position following the printing format of the recording device, and permits ink droplets to fly from the discharge opening to reproduce the recording data. The head 4 is subjected to main scanning, driven by the belt 6 with the motor 9 as the driving source. Every time one line of main scanning is completed, the motor 2 is driven to rotate the platen 1.

To prevent clogging of the discharge openings of the head 4, the cap 14 is positioned to cover the head 4 periodically or if necessary. This state is detected by the cap sensor 16, which then interrupts the process. The restoration process comprises absorbing the ink within the nozzles by an absorbing mechanism (not shown) within the cap 14, thereby removing foreign matter etc. within the nozzles. By doing so, the restoration process prevents any defective recording.

Next, the constitution of the control system shown in FIG. 2 will to be described.

CPU 20 constitutes the main body of control, to which are connected a group of switches 21 (arranged on the operational panel) through an input and output interface (not shown), a DC servo reversing circuit 22 for driving the carriage motor 9, a stepping motor driving circuit 23 for driving the line feed motor 2, a head driver 24 for driving the recording head 4 based on the recording data, a group of various sensors 25, the encoder sensor 11 and the home position sensor 13.

In the constitution shown in FIG. 2, CPU 20 performs the following operational steps corresponding to the operational input performed by the switch group 21 provided on the operational panel (not shown). More specifically, by referring to the input from the encoder sensor 11 and the home position sensor 13, the driving control of the carriage motor 9 is conducted through the DC servo reversing circuit 22, and also the driving control of the line feed motor 2 through the stepping motor driving circuit 23, whereby the recording data D are outputted to the head driver 24 to drive the recording head 4. Also, control of the other mechanisms corresponds to the inputs from another group of sensors 25.

Under this constitution, the recording process is commenced by actuating the print switch of the switch group 21. The line feed motor 2 is then driven several steps, on confirmation of the presence of recording paper by the paper sensor 10, rotate the platen 1 and set the recording paper at the recording start position. Subsequently, the carriage motor 9 is driven to move the recording head 4 in a reciprocating manner, and the line feed motor 2 is driven as synchronized therewith to deliver the recording paper line by line. During such actuation, driving signals corresponding to the recording data are applied from the head driver 24 on the to drive the recording head 4, whereby ink droplets are discharged through the openings of nozzle 5 to effect recording of letters, images, etc.

FIG. 3 shows a schematic perspective view of a head unit including the nozzle of the head 4 in FIG. 1. At the tip end of the tubular ink liquid path 41 pipe, a tapered nozzle 42 is formed therein. On the outer surface of the nozzle 42 near the discharge opening 5, a piezoelectric element 43 for generating energy used for discharging ink is externally positioned. Also, within the inlet of the ink liquid path 41, a filter 44 is inserted exclude foreign matters, impurities, etc. To the piezoelectric element 43 a head driver 24 is connected through a lead wire.

In the constitution in FIG. 3, ink is filled in the ink liquid path 41, and when a predetermined driving voltage is applied by the head driver 24 on the piezoelectric element 43, the piezoelectric element 43 creates a strain, thereby generating pressure in the ink liquid path 41 to discharge the ink droplets 47 from the discharge opening 5.

In this case, as shown in FIG. 4, in response to the input signal, first a voltage Vrev of negative polarity is generated for a time of T1, which voltage is applied to the piezoelectric element 43 to expand the ink liquid path 41. Next, a positive voltage Vop is generated for a time period T2, which is applied to the piezoelectric element 43 to reduce the ink liquid path 41, thereby discharging the ink as droplets 47. Further, the application voltage is gradually reduced over a time period T3, thereby effecting restoration actuaton of the nozzle diameter. By setting suitably the levels of the voltages Vrev, Vop or the time period T1, T2, the ink discharging amount can be varied. For example, (1) ink droplets of greater diameter can be discharged as the time period T1 is increased corresponding to the ink discharging amount. Also (2), with Vrev equal to zero volts, and by varying the voltage Vop or the time period T2, the ink droplet discharging amount can be effectively varied.

However, in such a recording method of the prior art, in the case according to the discharging control method of example (1) as described above, when ink droplets with large diameters are desired to be discharged, the pressure change within the ink liquid path must be made very great, whereby small bubbles are generated near the filter portion and the ink discharging can be maintained stably with difficulty.

On the other hand, in the case according to the discharging control method of the above example (2), no sufficient dynamic range from ink droplets with small diameters to ink droplets with large diameters could be obtained.

SUMMARY OF THE INVENTION

It is an object of the present invention to provide a method for driving an ink jet recording head which can expand dramatically the dynamic range by enabling discharging of ink droplets stably from a small ink droplet diameter to a large ink droplet diameter.

Another object of the present invention is to provide a method for driving ink jet recording head in an on-demand type ink jet recording device which applies electrical signals corresponding to recording data on a discharging energy generating member arranged in the vicinity of a nozzle to discharge ink droplets through said nozzle, characterized in that the above electrical signals have signal waveforms to sequentially enlarge, reduce and restore the ink liquid chamber, thereby changing the voltage value and its time width during the reduction step corresponding to the ink droplet diameter required.

BRIEF DESCRIPTION OF THE DRAWINGS

FIGS. 7A to 7E are timing charts corresponding to a second drive method of the present invention.

DESCRIPTION OF THE PREFERRED EMBODIMENT

The present invention enables expansion of dynamic range by use of electrical signals applied on a discharging energy generating member having signal waveforms which sequentially enlarge, reduce and restore the ink liquid chamber and by changing the voltage value during the reduction step and its elapse of time corresponding to the ink droplet diameter required, thereby accomplishing the above object.

Further, in addition to the changing of the reduction step voltage value, by changing the actuation time during the enlargement step in inverse proportion to the size of the ink droplet size required, the dynamic range can be further expanded.

By increasing the application voltage and the elapsed time during reduction of the ink liquid chamber as greater ink droplets are required, the pressure change in the ink liquid chamber of the head can be made smaller as compared with the actuation time during expansion, ink discharging can be effected even with greater ink droplets.

Further, in addition to the change in voltage and elapsed time during the reduction step, by decreasing the actuation time during expansion as the ink droplets are made greater, the pressure change within the ink liquid chamber can be decreased further, whereby the dynamic range of the size of the ink droplets can be further expanded.

The present invention will be described in detail below with reference to FIGS. 5 to 8.

FIG. 5A to FIG. 5E are operation waveform charts corresponding to a first drive method according to the present invention.

Figure 4:
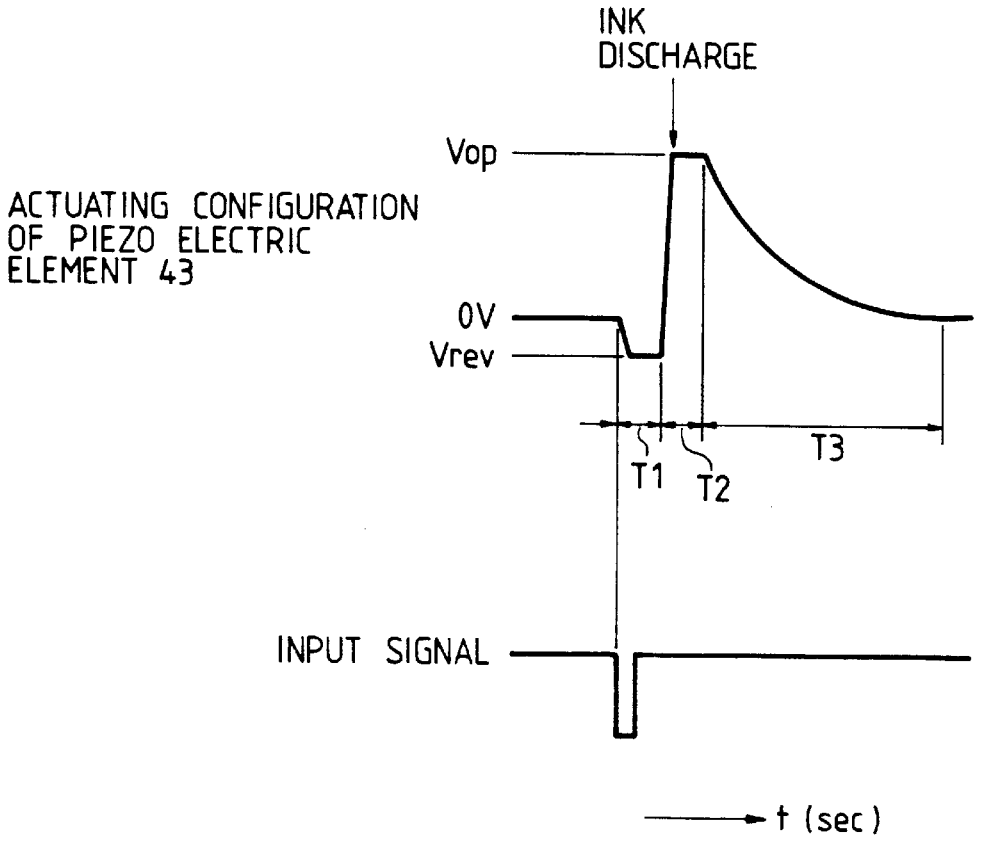
FIG. 4 is a drive signal waveform chart for ink discharge from the discharge openings of the head shown in FIG. 3, FIGS. 5A to 5E are timing charts corresponding to a first drive method of the present invention.
Figure 5A:
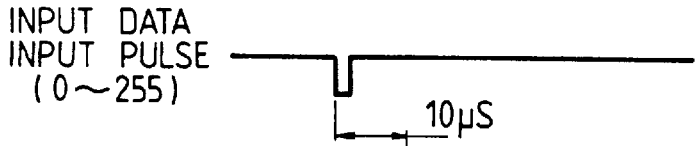
Figure 5B:
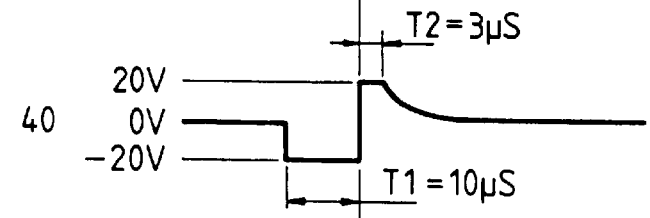
Figure 5C:
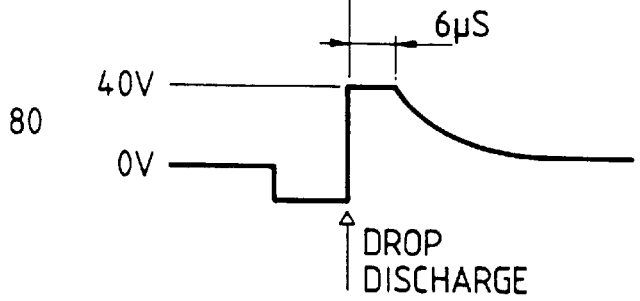
Figure 5D:
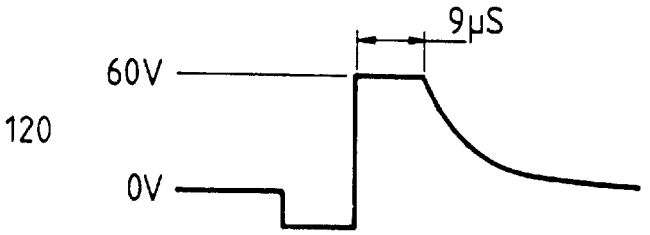
Figure 5E:
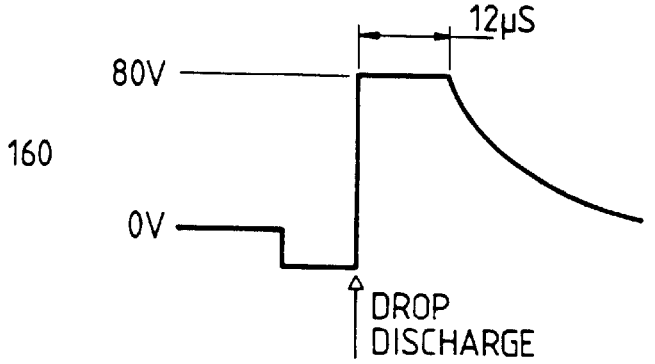

Input data D is given as a digital value of 8 bits ranging between 0 to 255, and the timing of the input pulse is shown in FIG. 5A. Of the setting values shown in FIG. 4, Vrev and T1 are constant values, and are determined to be Vrev=−20 V and T1=10 μs. Under this condition, an application voltage Vop in a contraction mode is set to be Vop=D/S (V). S is is selected to equal 2. Minimum and maximum values of Vop vary depending on the viscosity of the ink used. When ink with a viscosity of 7 cps at a temperature of 25° C. is used the, minimum value of Vop (Vop min) is about 20 V and the maximum value of Vop (Vop max) is about 80 V, although it varies depending on the nozzle used.

If Vop is too low, ink droplets can not be discharged or are discharged at a very low speed. If Vop is too high, bubbles are taken into the ink path from the front portion of the discharge opening, and the normal recording operation is disturbed. Thus, a limiter is included so that input data D arrives between a minimum value Dmin and a maximum value Dmax. On the other hand, the operation time period T2 in the contraction mode is set to be T2=0.15×D/2 (μs). Since the data D is limited by the limiter as described above, T2 is set between 3 to 12 μs.

Therefore, in this embodiment, Vop=D/2 (V), and T2=D/2×0.15 (μs). These parameters are simultaneously calculated changed in accordance with the value of the data D, thereby changing the ink drop size. When the data D is input at 40, 80, 120 and 160, Vop and T2 change as shown in Table 1.

FIG. 5B to FIG. 5E show drive signal waveforms corresponding to Vop and T2 shown in Table 1. As can be seen from these waveforms, as the value of the data D is increased Vop and T2 are increased, and the size of an ink drop discharged from a discharge opening of the head is increased.

TABLE 1

| Data D | Application Voltage Vop in Contraction Mode | Lapse Time T2 in Contraction Mode |
|---|---|---|
| 40 | 20 V | 3 μs |
| 80 | 40 V | 6 μs |
| 120 | 60 V | 9 μs |
| 160 | 80 V | 12 μs |

When Vop and T2 are obtained from the data D, a 10 μs pulse is generated by a timer circuit in synchronism with an input pulse, and this pulse is represented by T1. A pulse T2=0.15×D/2 (μs) is generated by a counter in accordance with the data D. Simultaneously, a voltage Vout=0.5×D is applied to a D/A converter in a head driver 24. The head driver 24 drives a piezoelectric element 43, having a capacitance of about 500 pF, on the basis of the above signal.

A value of 13.33 MHz is used for a master clock of CPU 20, and frequency of the clock is 0.075 μsec.

T2 is determined as T2=0.15×D/2 μsec which is equal to the master clock of CPU 20, thus they are used in common. If value of 26.67 MHz is selected for the master clock the value made by dividing this value into two is used for determining T2 to use them in common.

Thus, since varying rate of the Vop relative to the input data and varying rate of the T2 are selected as equal, the circuit construction of the head driver can be minimized.

Figure 6:
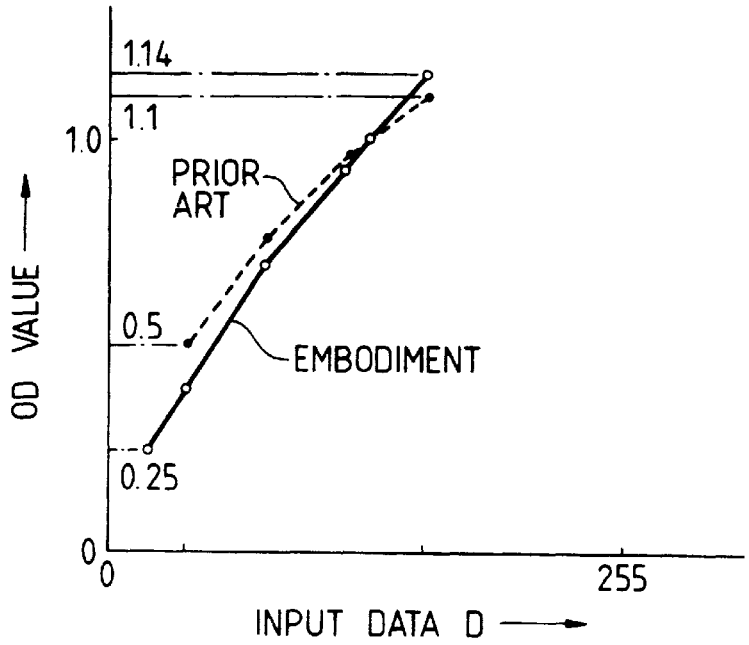
FIG. 6 is a graph showing OD value characteristics comparing the first drive method of the present invention and a conventional method.

FIG. 6 is a graph showing the relationship between a change in value of the data D and an optical reflection density (OD) value, and exemplifies a cyan color. In this case, T2=10 μs, and ink drops have a one-to-one correspondence in the present invention and the prior art (note that the OD value means output characteristics i.e. characteristics corresponding to the diameter of the ink droplet from the recording apparatus).

As can be seen from FIG. 6, in the prior art, a value of a range ratio R0 of an OD maximum value to an OD minimum value is Ro=1.1/0.5=2.2, while in this embodiment, a value of ratio R1 is R1=1.14/0.25=4.56. Therefore, 4.56/2.2≈2.1 (times), i.e. the range ratio of this embodiment is twice or more that of the prior art.

A second embodiment of the present invention will now be described with reference to FIG. 7. In this embodiment, an interval of the time period T1 is also controlled in addition to the above embodiment.

Figure 1:
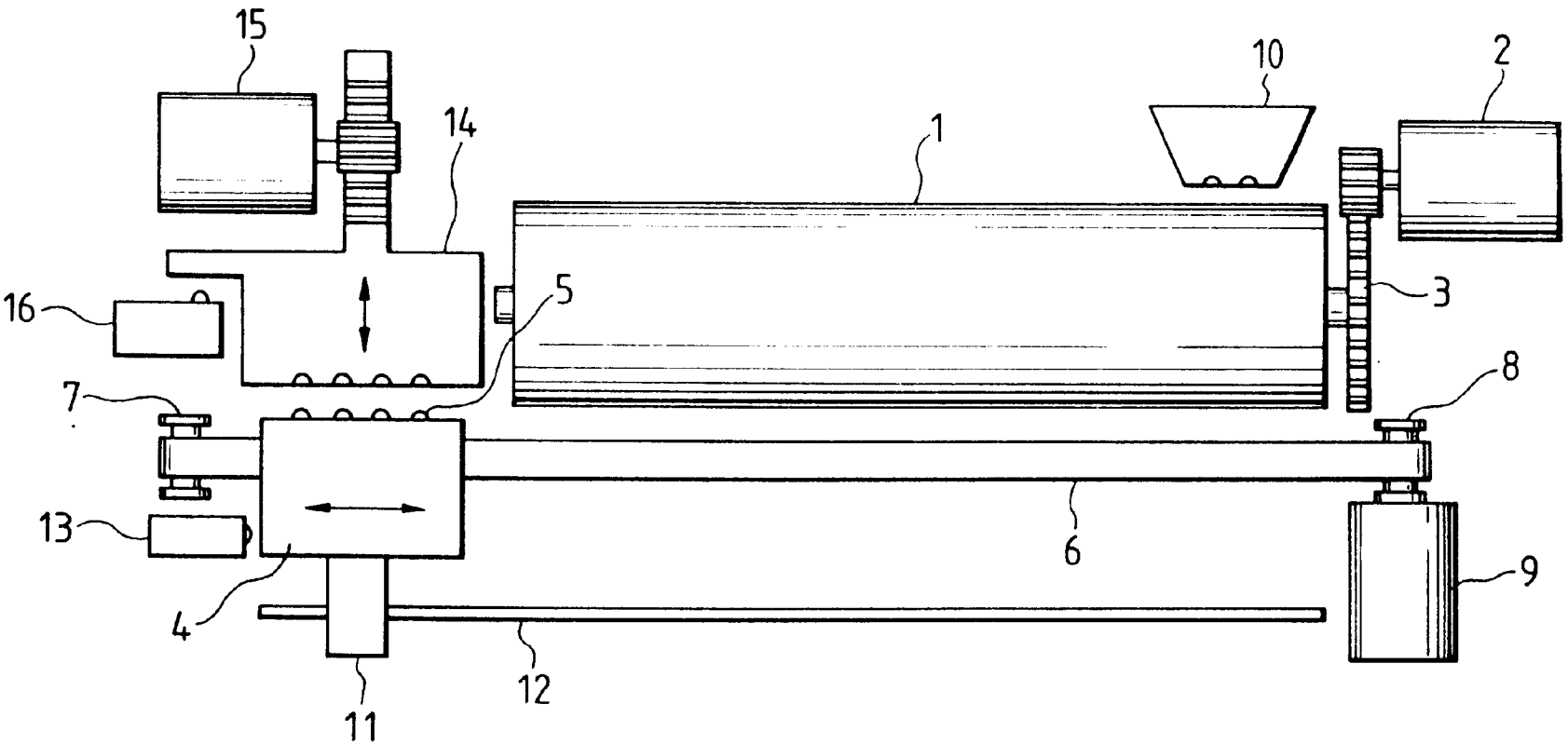
FIG. 1 PRIOR ART
FIGS. 1 and 2 are respectively a front view of an ink-jet recording apparatus and a block diagram showing its control system.
Figure 2:
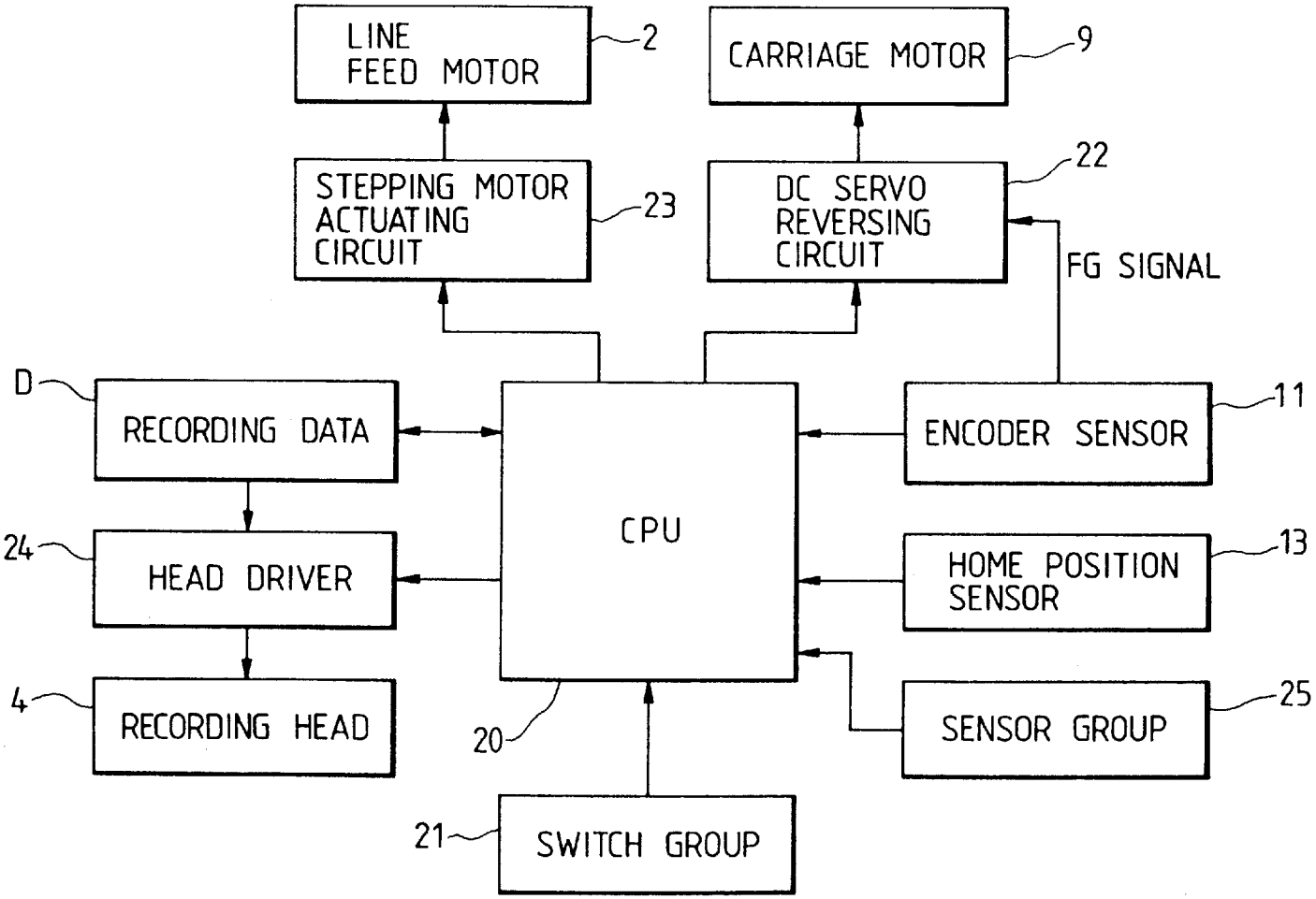

As shown in FIG. 7A, the generation interval of input pulses is set to be longer than that (10 μs) in FIG. 1A with respect to the generation interval of the voltage Vop, i.e., 18 μs, and the generation timing of the time T1 is set with reference to this interval or period. The time interval T1 is decreased as the value of data D is increased, as shown in FIGS. 7B to 7E. On the other hand, Vop and T2 are increased as the data D is increased like in FIGS. 5B to 5E. Furthermore, since T1+T2=18 μs, Vop, T2 and T1 are changed according to the input data value, and a single counter circuit (not shown) independently operated in correspondence with each nozzle can be used for each nozzle in a head driver 24, thus simplifying the arrangement.

In addition, since the varying rate of the Vop relative to the input data and the varying rates of the T1 and T2 are equal, the size of the circuit construction of the head driver can be minimized.

The driving method according to the second embodiment will now be described.

Figure 3:
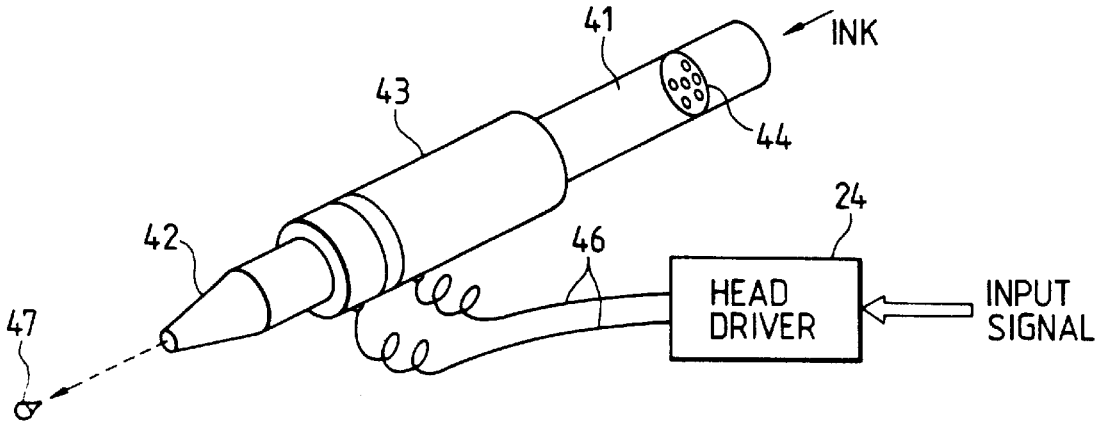
FIG. 3 is a perspective view of a head unit including the nozzle of the head shown in FIG. 1.

When an input pulse is supplied, as shown in FIG. 7A, an expansion voltage having a time interval T1 (15 μs) is generated after the lapse of the time T2 is synchronism with the input pulse, thus expanding the ink path 41. Vop having an inverted voltage polarity is generated to have the time interval T2 (3 μs) to contract the ink chamber 41, and an ink drop 47 is discharged and flies from the discharge opening 42, as shown in FIG. 3. Then, a recovery operation is performed to ready the head for the next discharge operation.

In this manner, the time interval T2 is used twice in the injection process, so that a single timer circuit can be used twice, thus simplifying the arrangement. These circuits are provided for nozzles of ink colors of cyan, magneta, yellow, and black.

In this embodiment, an ink injection timing pulse is reached 18 μs after the input of the input pulse, and is delayed 8 μs as compared to the first embodiment. This can be corrected by any method.

When the data D is increased, the time interval T1 can be changed, as shown in FIGS. 7C to 7E. In this manner, when T1 is decreased as Vop and T2 are increased, a variation in pressure in the ink path can be relatively small. Therefore, a large ink drop can be stably ejected.

Figure 8:
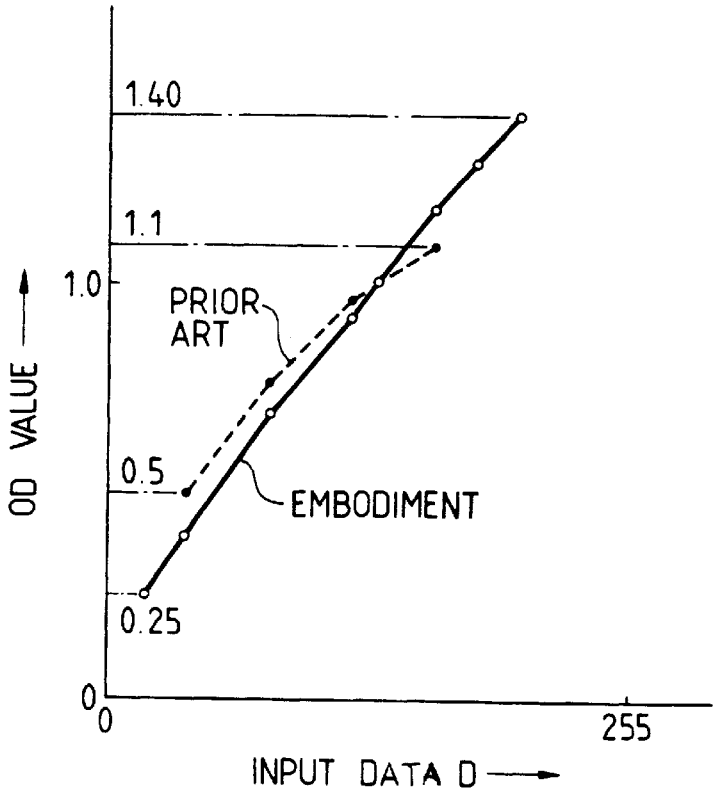
FIG. 8 is a graph showing OD value characteristics comparing the second drive method of the present invention and a conventional method.

Therefore, as shown in FIG. 8, the range ratio R2 of an OD maximum value to an OD minimum value is 1.40/0.25=5.6. In this manner, a dynamic range can be further extended as compared to FIG. 6. In particular, an increase in output OD value at a high input data side is an indication of an effect caused by decreasing the time interval T1.

Note that conditions in FIGS. 7A to 7E are as follows:

Vrev=−20 V (constant), Vop=0.5×D

T1=18−T2 (μs)

T2=0.15×D/2 (μs)

T1+T2=18 μs (constant)

In the above embodiment, the sum or total of T1 and T2 are made in constant, but this is true only under the condition that the viscosity of the ink is 7 cps at 25° C. In general, viscosity of the ink varies depending on temperature. As temperature is lower and, therefore, viscosity is lower, it is desirable to select a smaller sum of T1 and T2 to obtain the above advantage. Ink temperature is transmitted to CPU 20 as a digital signal by a temperature sensor provided in the sensor group 25. Because the varying rate of the ink temperature relative to time is small, the value of the sum of T1 and T2 is determined corresponding to the digital signal transmitted just before recording starts to record at a constant value, on a a designated, discreet area (here, one sheet of size A4).

As can be apparent from the above description, an electrical signal applied to the head forms a signal waveform for sequentially expanding, contracting and recovering the ink chamber, and both of a voltage value and its time interval in the contraction mode of the ink path are changed in accordance with a required ink drop size. Thus, a dynamic range can be significantly extended from a samll ink drop to a large ink drop.

In addition to the injection control, the time interval of the expansion step of the ink path is decreased as the ink drop size is increased, thus further extending the dynamic range.

Thus, according to the present invention, the driving method of the ink jet recording head which allows better gradient recording.

What is claimed is:

1. A driving method for an ink jet recording head having an electric converting element provided to vary a volume of an ink path through which an ink flows to perform a gradient recording in accordance with a recording information, the electric converting element being driven by applying electric signals including a first driving pulse for enlarging the volume of the ink path, the first driving Pulse having a duration t1, and a second driving pulse for reducing the volume of the ink path, the second driving pulse having a duration t2, said method comprising the steps of:

selecting the duration t2 of the second driving pulse and a voltage of the second driving pulse corresponding to the recording information;

inputting an input pulse representing a reference timing for beginning driving of the electric converting element;

delaying a start of the first driving pulse after the input pulse until a first time period corresponding to the duration t2 passes; and delaying a start of the second driving pulse after the input pulse until a second predetermined time period corresponding to a sum of t1 and t2 passes.

2. A driving method according to claim 1, wherein in said second varying step, the width t2 and the voltage of the second driving pulse are only both increased or both decreased in response to a change in the input recording information, so that a ratio of the width t2 to the voltage of said second driving pulse remains constant.

3. A driving method according to claim 1, wherein in said second varying step including said energizing of the electric converting element, a ratio of the increased second driving pulse width t2 to the decreased second driving pulse width t2, and a ratio of the increased second driving pulse voltage to the decreased second driving pulse voltage, are the same.

4. A driving method according to claim 1, wherein in said controlling step, the sum of the width t1 of the first driving pulse and the width t2 of the second driving pulse is constant for a predetermined temperature, and wherein a value of the sum of the first driving pulse width ti and the second driving pulse width t2 varies with temperature.

5. A driving method according to claim 1, wherein in said first varying step, a value of the first driving pulse voltage, upon energizing the electric converting element, is −20V.

6. A driving method according to claim 1, wherein the in said second varying step the voltage of the second driving pulse, upon energizing the electric converting element, is in the range of 20V to 80V inclusive.

7. A driving method according to claim 1, wherein the electric converting element is a piezoelectric element.

8. A driving method according to claim 1, further comprising the step of waiting for a delay time period t2 to elapse in which said delay time period t2 is the same as the width t2 of the second driving pulse.

9. An ink jet recording apparatus comprising:

an ink jet recording head having an electric converting element provided to vary a volume of an ink path through which an ink flows to perform a gradient recording in accordance with a recording information inputted;

a driver for applying an electrical signal to drive the electrical converting element, the electrical signals including a first driving pulse for enlarging the volume of the ink path, the first driving pulse having a duration t1 and a second driving pulse for reducing the volume of the ink path, the second driving pulse having a duration t2;

a determining means for determining the duration t2 and a voltage of the second driving pulse corresponding to the recording information; and a control means for controlling the electric converting element by applying for the duration t1 the first driving pulse after a predetermined time period corresponding to the duration t2 passes after a reference timing, and by delaying a start of the second driving pulse after the input pulse until a second predetermined time period corresponding to the sum of duration t1 and duration t2 passes.

10. An ink jet recording apparatus according to claim 9, wherein said control means comprises a counter circuit for counting the width t2 of the second driving pulse.

11. An ink jet recording apparatus according to claim 9, wherein the width t2 and the voltage of the second driving pulse are only both increased or both decreased in response to a change in the input recording information, so that a ratio of the width t2 to the voltage of the second driving pulse remains constant.

12. An ink jet recording apparatus according to claim 9, wherein in energizing the electric converting element, a ratio of the increased second driving pulse width t2 to the decreased second driving pulse width t2, and a ratio of the increased second driving pulse voltage to the decreased second driving pulse voltage, are the same.

13. An ink jet recording apparatus according to claim 9, wherein the sum of the width t1 of the first driving pulse and the width t2 of the second driving pulse is constant for a predetermined temperature, and wherein a value of the sum of the first driving pulse width t1 and the second driving pulse width t2 varies with temperature.

14. An ink jet recording apparatus according to claim 9, wherein a value of the first driving pulse voltage, upon energizing the electric converting element, is −20V.

15. An ink jet recording apparatus according to claim 9, wherein the second driving pulse voltage, upon energizing the electric converting element, is in the range of 20V to 80V inclusive.

16. An ink jet recording apparatus according to claim 9, wherein the electric converting element is a piezoelectric element.

17. An ink jet recording apparatus according to claim 11, wherein said control means allows a delay time period t2 to elapse which is the same as the width t2 of the second driving pulse.

* * * * *

UNITED STATES PATENT AND TRADEMARK OFFICE

CERTIFICATE OF CORRECTION

PATENT NO. : 6,059,394
DATED : May 9, 2000
INVENTOR(S) : Jiro Moriyama

It is certified that error appears in the above-identified patent and that said Letters Patent is hereby corrected as shown below:

Title page, item [57], ABSTRACT,
Line 2, "electrical" should read -- electric --;
Line 5, "electrical" should read -- electric --;
Line 6, "trical" should read -- tric --; and
Line 8, "a second" should read -- a second driving pulse for reducing the volume of the ink path, the second --.

Column 1
Line 30, "1, the" should read -- 1. The --;
Line 45, "for" should read -- for moving the cap 14 forward and backward --;
Line 48, "it" should be deleted; and "to be made" should be deleted; and
Line 49, "in a recordable state." should read -- detects whether it is in a recording position. --

Column 2,
Line 28, "rotate" should read -- to rotate --;
Line 35, "on the" should be deleted;
Line 40, "41 pipe," should read -- 41 --
Line 41, "formed therein." should read -- formed. --;
Line 45, "exclude" should read -- to exclude --.

Column 3,
Line 59, "of" should read -- of the --.

Column 4,
Line 27, "is is" should read -- is --; and
Line 30, "C." should read -- C --; and "used the," should read -- used, the --.

Column 6,
Line 13, "R2" should be deleted;
Line 37, "a a" should read -- a --;
Line 42, "of" should be deleted; and
Line 60, "Pulse" should read -- pulse --.

UNITED STATES PATENT AND TRADEMARK OFFICE

CERTIFICATE OF CORRECTION

PATENT NO. : 6,059,394
DATED : May 9, 2000
INVENTOR(S) : Jiro Moriyama

It is certified that error appears in the above-identified patent and that said Letters Patent is hereby corrected as shown below:

Column 7,
Line 26, "ti" should read -- t1 --; and
Line 31, "the" should be deleted.

Signed and Sealed this

Second Day of October, 2001

*Attest:*

Nicholas P. Godici

NICHOLAS P. GODICI
*Acting Director of the United States Patent and Trademark Office*

*Attesting Officer*